US008066830B2

(12) United States Patent
Bode et al.

(10) Patent No.: US 8,066,830 B2
(45) Date of Patent: Nov. 29, 2011

(54) METHOD FOR PRODUCING A SHAFT FOR COMPRESSORS

(75) Inventors: Ralf Bode, Moers (DE); Beate Langenhan, Niederkrüchten (DE)

(73) Assignee: Siemens Aktiengesellschaft, Munich (DE)

( * ) Notice: Subject to any disclaimer, the term of this patent is extended or adjusted under 35 U.S.C. 154(b) by 218 days.

(21) Appl. No.: 12/310,689

(22) PCT Filed: Sep. 13, 2006

(86) PCT No.: PCT/EP2006/066319

§ 371 (c)(1),
(2), (4) Date: Mar. 3, 2009

(87) PCT Pub. No.: WO2008/031457

PCT Pub. Date: Mar. 20, 2008

(65) Prior Publication Data

US 2009/0242084 A1 Oct. 1, 2009

(51) Int. Cl.

| | |
|---|---|
| ***C21D 9/28*** | (2006.01) |
| ***C21D 6/00*** | (2006.01) |
| ***C21D 1/18*** | (2006.01) |

(52) U.S. Cl. ..... 148/595; 148/663; 148/664

(58) Field of Classification Search ..... 148/232–233, 148/595, 660, 662–664

See application file for complete search history.

(56) References Cited

U.S. PATENT DOCUMENTS

| | | | | |
|---|---|---|---|---|
| 5,536,335 | A * | 7/1996 | Burris | 148/233 |
| 6,149,734 | A | 11/2000 | Isogai et al. | |
| 2002/0124911 | A1 * | 9/2002 | Hetzner | 148/233 |

FOREIGN PATENT DOCUMENTS

| | | | |
|---|---|---|---|
| DE | 2039910 | A1 | 5/1972 |
| JP | 2133518 | A | 5/1990 |
| JP | 4325625 | A | 11/1992 |
| JP | 10265846 | A | 10/1998 |
| SU | 1423609 | A1 | 9/1988 |
| SU | 1439133 | A1 | 11/1988 |

OTHER PUBLICATIONS

English language machine translation of JP10265846 to Oi et al.*
Wegst et al., "Stahlschlüssel" 2004, Verlag Stahlschlüssel Wegst GMBH, Marbach 20, XP002369727, ISBN:3-922599-20-6; Others; 2004; DE.
Database WPI Week 198912, Derwent Pulications Ltd., London, GB, AN, 1989-091717, XP002436238.
Database WPI Week 198930, Derwent Publications Ltd., London, GB, AN, 1989-219369, XP002436239.

* cited by examiner

*Primary Examiner* — Stanley Silverman
*Assistant Examiner* — Brian Walck

(57) ABSTRACT

A method for the production of steels is provided. A heat treatment is carried out, in which the steel is hardened in water twice at different high temperatures, and subsequently subjected to an annealing treatment. It has been shown that the steel 26NiCrMoV14-5 has a high subzero toughness. In one aspect, the steel is usable down to a temperature of at least minus 170° C.

12 Claims, No Drawings

METHOD FOR PRODUCING A SHAFT FOR COMPRESSORS

CROSS REFERENCE TO RELATED APPLICATIONS

This application is the US National Stage of International Application No. PCT/EP2006/066319, filed Sep. 13, 2006 and claims the benefit thereof and is incorporated by reference herein in its entirety.

FIELD OF INVENTION

The invention relates to a method for producing a shaft for compressors.

BACKGROUND OF INVENTION

In present-day mechanical engineering, it is routine for steel to be used at temperatures lower than minus 100° C., for example in compressors. Most grades of steel have a ferritic/martensitic crystal structure and become very brittle at these low temperatures. Accordingly, these grades of steel cannot be used for many applications at minus 100° C. This could be remedied by using other steels, namely tough-at-subzero steels, instead of grades of steel with a ferritic/martensitic crystal structure. Tough-at-subzero steels are characterized by their austenitic structure and are comparatively soft. In addition, these tough-at-subzero steels have low strength.

In the case of solid bodies, toughness is to be understood as meaning the property of being able to undergo macroscopically measurable plastic deformation under mechanical stress. Toughness may also refer to the degree of resistance with which a body opposes a plastic change of shape, i.e. the level of mechanical stress and/or energy that has to be exerted to produce deformation. Brittleness may be considered to be the converse property.

SUMMARY OF INVENTION

In order for steels to be used nevertheless in demanding mechanical engineering applications at lower than minus 100° C., steels of higher strength, with 10% to 20% of their structure made up by austenite, are used. These steels additionally also still exhibit good low-temperature properties. The proportion of 10% to 20% austenite is obtained by specific heat treatment and an alloy content of 9% nickel. This steel is also known by the standard designation X8Ni9.

However, one disadvantage of 9% nickel steel is that it begins to flow comparatively early under mechanical stress. In addition, it is possible that, for example, shafts of compressors deform when they are exposed to different temperatures. This occurs in particular whenever the austenite is unevenly distributed in the shaft.

A martensitic material of the type 26 NiCrMoV14-5 is already known from the Stahlschlüssel [key to steel] from the year 2004 (C. WEGST, M. WEGST, Verlag Stahlschlüssel WEGST GmbH). The production of steel plates in a continuous casting process with subsequent heat treatment in two hardening steps and a tempering step is already known from JP 10 26 58 46 A. Heat treatment for the production of high-strength steels with good low-temperature properties from a non-martensitic starting product, with two hardenings at different temperatures and subsequent tempering, is already known from the document JP 02133518 A.

This is where the invention comes in, the object being to provide a method for producing a steel whereby the toughness at subzero temperatures of a steel is increased and the method can be easily implemented.

The object is achieved by a method for producing steels in which a heat treatment is carried out on a martensitic steel, a heat treatment comprising hardening and tempering and characterized by the following steps being carried out:

a) hardening at a temperature between 920° C. and 960° C., b) carrying out a second hardening at a temperature between 820° C. and 860° C., c) tempering at a temperature between 620° C. and 660° C.

To be regarded as one of the advantages is that the method offers a comparatively simple possible way of improving a steel in the sense that it has great toughness at subzero temperatures. The invention is based here on the aspect that a standard heat treatment, which provides a first and only hardening operation at about 850° C. with a tempering operation at about 630° C. under air cooling, does not produce satisfactory properties of the steel. The heat treatment according to the invention, in which first hardening at a first temperature and second hardening at a second temperature take place with quenching in water and then tempering takes place at a temperature in the specified temperature range surprisingly produces a steel of comparatively great toughness at subzero temperatures. This steel can be used down to at least minus 170° C., for example as a material for compressor shafts.

In an advantageous development, martensitic steel of the type 3.5% Ni and 1.5% Cr, in particular the steel 26NiCrMoV14-5 according to Stahl-Eisen-Werkstoffblatt (SEW) [steel-iron material sheet] 555, is used in the method.

It has been found that a martensitic steel is specifically suitable in particular for this method. In addition, martensitic steel can be produced particularly easily and therefore at lower cost.

Particularly the steel 26NiCrMoV14-5 is a steel that can be provided with comparatively great toughness at subzero temperatures by the heat treatment according to the invention. In particular, the steel can be used as a material for compressor shafts. In addition, the steel 26NiCrMoV14-5 is, as it were, a standard shaft material for turbines and generators and is therefore more readily available than, for example, the steel with the designation X8Ni9. For example, the steel X8Ni9 has to be produced in special melts. Furthermore, the steel 26NiCrMoV14-5 is less expensive than X8Ni9 because of its lower content of alloying elements.

A further advantage is that the martensitic crystal structure leads to more favorable behavior under mechanical stress.

A further advantage is that a uniform crystal structure avoids peculiarities in the thermal expansion behavior.

In a further advantageous development, the quenching in the hardening operations in steps a) and b) takes place in water. This provides a possible way of making the hardening operation particularly inexpensive. A further aspect here is that the quenching with water leads to good results.

In a further advantageous development, the tempering operation is carried out with air cooling.

Here, too, the particular advantage can be seen in the fact that air cooling provides a simple method by which very good results are achieved. The steel produced by this method exhibits very great toughness at subzero temperatures.

Exemplary embodiments of the invention are described in more detail below.

Instead of a 9% nickel steel, the steel 26NiCrMoV14-5 is used. A method for increasing the toughness of steels at subzero temperatures is used, involving carrying out a heat treatment that is distinguished by the following steps:

1) hardening at a temperature between 920° C. and 960° C.,
2) carrying out a second hardening at a temperature between 820° C. and 860° C. and
3) tempering at a temperature between 620° C. and 660° C.

It has been found that the temperature in the first hardening operation should be, in particular, around 950° C. Ideally, the temperature in the second hardening should be at a value of about 850° C.

It has similarly been found that the temperature during the tempering operation should ideally be around 630° C. By this particular heat treatment, it is possible to provide the martensitic steel 26NiCrMoV14-5 with such great toughness at subzero temperatures that it can be used down to at least minus 170° C. as a material for compressor shafts. There are, however, other possible uses for this heat-treated steel. It has been found that it is not out of the question for good batches of the steel 26NiCrMoV14-5 even to have adequate toughness at subzero temperatures after the standard heat treatment, i.e., using the standard heat treatment, first hardening is performed at about 850° C. with quenching under water and then tempering is performed at a temperature of 630° C. with air cooling. However, to ensure very good values with respect to toughness at subzero temperatures, as required in cryogenic compressors, the heat treatment according to the invention is required.

The invention claimed is:

1. A method of heat treatment for producing a shaft for compressors from a shaft material following a specified set of steps, comprising:

a first hardening at a temperature between 920° C. and 960° C.;

a second hardening at a temperature between 820° C. and 860° C.; and tempering at a tempering temperature between 620° C. and 660° C., wherein the heat treatment is carried out on a martensitic steel, wherein the martensitic steel is 26NiCrMoV14-5.

2. The method as claimed in claim 1, wherein a quenching in the first hardening and the second hardening occur in water.

3. The method as claimed in claim 1, wherein air cooling occurs in the tempering operation.

4. The method as claimed in claim 1, wherein the temperature in the first hardening is approximately 950° C.

5. The method as claimed in claim 1, wherein the temperature in the second hardening is approximately 850° C.

6. The method as claimed in claim 1, wherein the temperature during the tempering operation is approximately 630° C.

7. A method of heat treatment for producing a shaft for compressors from a shaft material following a specified set of steps, comprising:

providing a martensitic steel 26NiCrMoV14-5 as the shaft material;

a first hardening at a temperature between 920° C. and 960° C.;

a second hardening at a temperature between 820° C. and 860° C.; and tempering at a tempering temperature between 620° C. and 660° C., wherein the heat treatment is carried out on a martensitic steel, wherein the quenching in the first hardening and the second hardening occur in water, and wherein the martensitic steel 26NiCrMoV14-5 is usable down to a temperature of at least minus 170° C. for a part on a gas turbine system.

8. A method of heat treatment for producing a shaft for compressors from a shaft material following a specified set of steps, comprising:

providing a martensitic steel 26NiCrMoV14-5 as the shaft material, a first hardening at a temperature between 920° C. and 960° C.;

a second hardening at a temperature between 820° C. and 860° C.; and tempering at a tempering temperature between 620° C. and 660° C., wherein a quenching in the first hardening and the second hardening occur in water.

9. The method as claimed in claim 8, wherein air cooling occurs in the tempering operation.

10. The method as claimed in claim 8, wherein the temperature in the first hardening is approximately 950° C.

11. The method as claimed in claim 8, wherein the temperature in the second hardening is approximately 850° C.

12. The method as claimed in claim 8, wherein the temperature during the tempering operation is approximately 630° C.

* * * * *